US010157599B2

(12) United States Patent
Chen

(10) Patent No.: US 10,157,599 B2
(45) **Date of Patent: *Dec. 18, 2018**

(54) FASTENING DEVICE, DRUM HOOP FASTENING DEVICE AND DRUM HAVING THE SAME

(71) Applicant: Kuo-Chang Chen, Taichung (TW)

(72) Inventor: Kuo-Chang Chen, Taichung (TW)

( * ) Notice: Subject to any disclaimer, the term of this patent is extended or adjusted under 35 U.S.C. 154(b) by 0 days.

This patent is subject to a terminal disclaimer.

(21) Appl. No.: 15/935,953

(22) Filed: Mar. 26, 2018

(65) Prior Publication Data

US 2018/0218719 A1 Aug. 2, 2018

Related U.S. Application Data

(63) Continuation-in-part of application No. 15/408,119, filed on Jan. 17, 2017, now abandoned.

(51) Int. Cl.
*G10D 13/02* (2006.01)

(52) U.S. Cl.
CPC ..... *G10D 13/023* (2013.01)

(58) Field of Classification Search
CPC ..... G10D 13/023
USPC ..... 84/413, 411 R
See application file for complete search history.

(56) References Cited

U.S. PATENT DOCUMENTS 7,291,777 B2 * 11/2007 Chen ..... G10D 13/023 84/421
7,960,633 B1 * 6/2011 Chen ..... G10D 13/023 84/411 R

* cited by examiner

*Primary Examiner* — Jianchun Qin
(74) *Attorney, Agent, or Firm* — Muncy, Geissler, Olds & Lowe, P.C.

(57) ABSTRACT

A drum hoop fastening device is provided for being disposed on a drum. A first connecting portion is arranged on a drum hoop, an exterior circumferential wall of a drum shell has a second connecting portion, the first connecting portion has a first through hole, the second connecting portion has a connecting hole, and the drum hoop fastening device includes a fixing member and a fastening member. The fixing member is abutted against the drum, and has a second through hole. The fastening member is disposed through the first and second through holes and screwed with the connecting hole for fixing the drum hoop on the drum shell, and when the fastening member rotates, an exterior circumferential wall of the fastening member circumferentially interferes the fixing member.

12 Claims, 7 Drawing Sheets

FASTENING DEVICE, DRUM HOOP FASTENING DEVICE AND DRUM HAVING THE SAME

The present invention is a CIP of application Ser. No. 15/408119, filed Jan. 17, 2017, the entire contents of which are hereby incorporated by reference.

BACKGROUND OF THE INVENTION

Field of the Invention

Description of the Prior Art

Conventionally, a drum has a drum shell which is hollow, a drumhead covering two opening ends of the drum shell respectively and a drum hoop covering the drumhead and the drum shell, and an exterior periphery of the drum shell has a plurality of connecting portions. A user can adjust a tightness of the drumhead through adjusting a position of the drum hoop covering the drum shell. A plurality of bolts are respectively disposed through a plurality of through holes of the drum hoop and screwed with the connecting portions, the user can screw and move relative positions of the bolts and the connecting portions to change the position of the drum hoop and further to adjust the tightness of the drumhead so as to adjust a sound and a tune produced when the drumhead is hit.

However, the drum vibrates when being hit, the drum hoop of the drum contacts the bolts; therefore, when the drum vibrates, the drum hoop transmits a seismic wave produced to the bolts so that the bolts loosen and shake easily. After the bolts loosen, the drumhead get loose, and the sound and the tune of the drum change, so the bolts of the conventional drum need to repeatedly adjusted. In addition, fastening members of machines, such as audio equipment or machine tools, may also get loose due to vibration.

U.S. Pat. No. 7,291,777 discloses that a cylindrical bolt is disposed through the circular hole of the washer and into the circular hole of the connector, which cannot effectively prevent the bolt from loosening due to the vibration produced when the drum vibrates.

The present invention has arisen to mitigate and/or obviate the afore-described disadvantages.

SUMMARY OF THE INVENTION

The major object of the present invention is to provide a fastening device, a drum hoop fastening device and a drum having the same which can effectively prevent the fastening device from loosening due to the vibration produced when an object (the drum) vibrates.

To achieve the above and other objects, a drum hoop fastening device is provided. The drum hoop fastening device is for being disposed on a drum, the drum includes a drum shell, a drumhead arranged on the drum shell, a drum hoop covering an opening end of the drum shell and the drumhead and a first connecting portion arranged on the drum hoop, an exterior circumferential wall of the drum shell has a second connecting portion, the first connecting portion has a first through hole along an axial direction, the second connecting portion has a connecting hole along the axial direction, and the drum hoop fastening device includes a fixing member and a fastening member. The fixing member is abutted against the drum, and the fixing member has a second through hole along the axial direction. The fastening member is disposed through the first and second through holes and screwed with the connecting hole for fixing the drum hoop on the drum shell, and when the fastening member rotates, an exterior circumferential wall of the fastening member circumferentially interferes the fixing member.

To achieve the above and other objects, a drum is further provided, including a plurality of the drum hoop fastening devices mentioned above, and the drum further includes a drum shell, at least one drumhead, at least one drum hoop and at least one first connecting portion. An exterior circumferential wall of the drum shell has a plurality of second connecting portions. The at least one drumhead is arranged on the drum shell. The at least one drum hoop covers an opening end of the drumhead and the drum shell. Each said first connecting portion having a first through hole along an axial direction The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
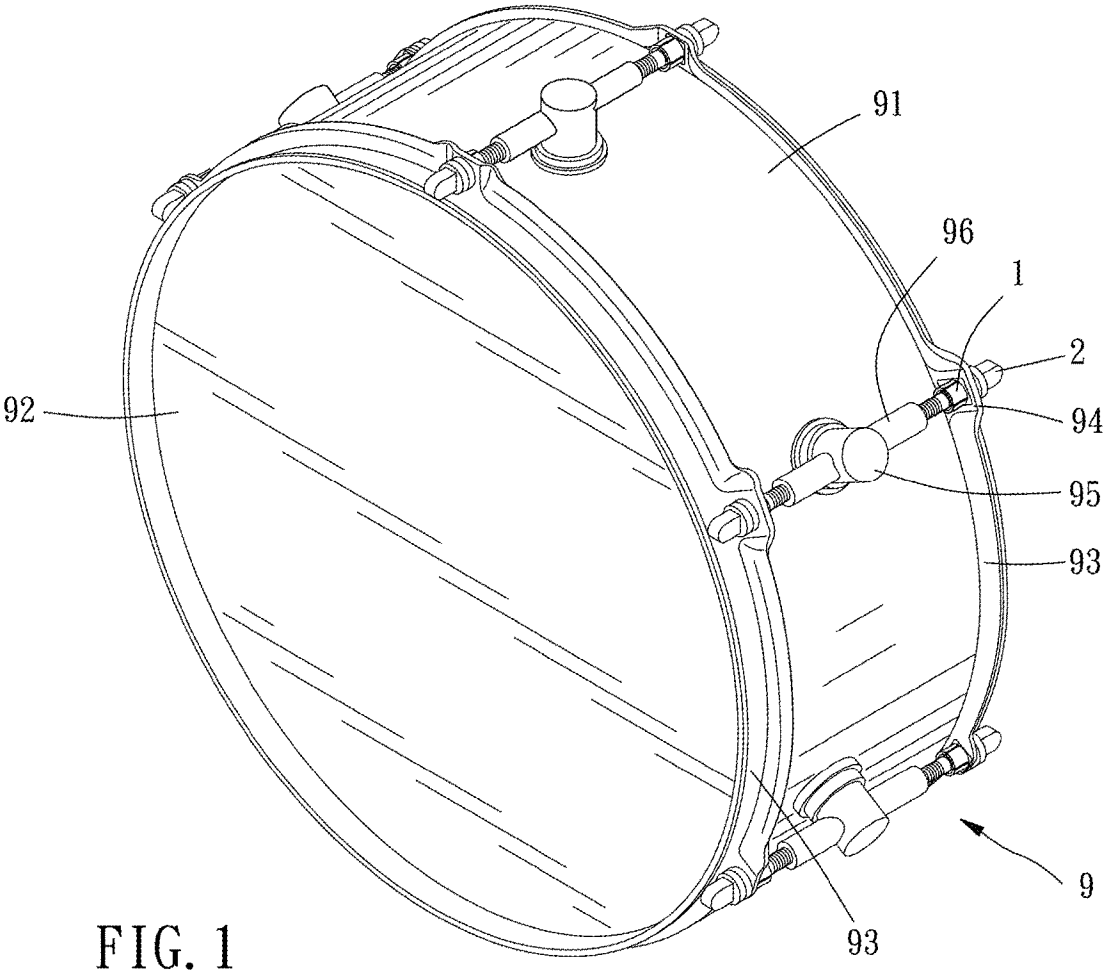
FIG. 1 is a stereogram of a first preferred embodiment of the present invention.
Figure 2:
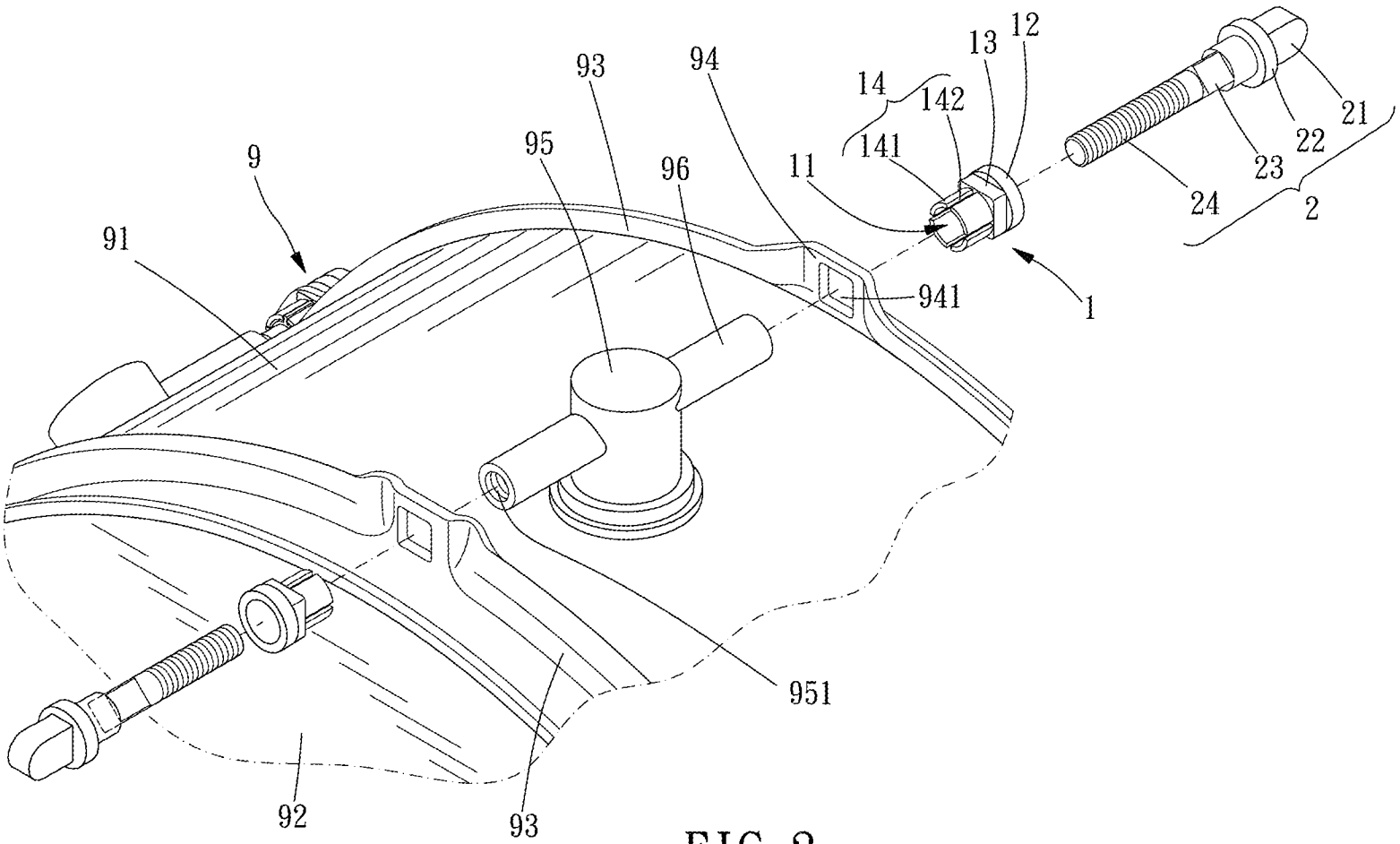
FIG. 2 is a breakdown view of the first preferred embodiment of the present invention.
Figure 4:
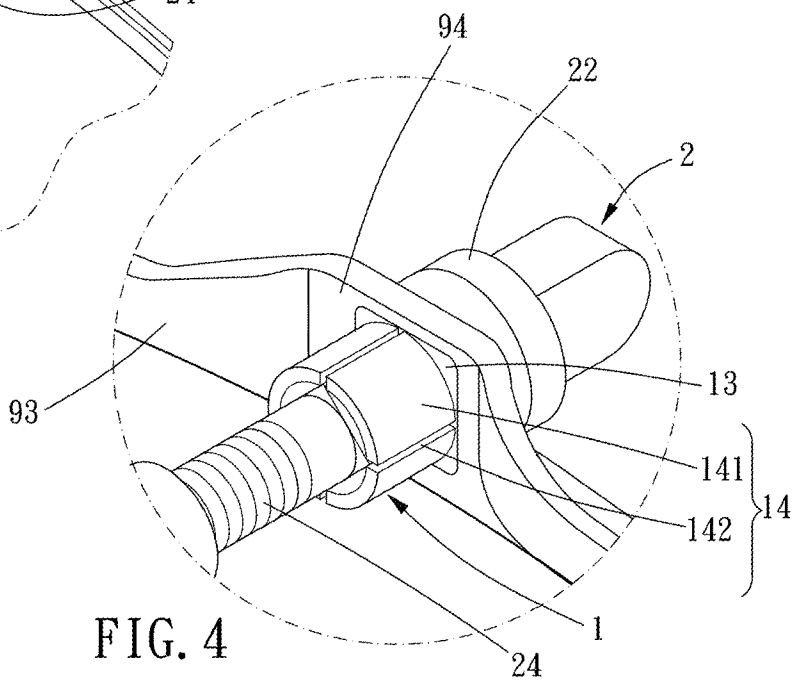
FIG. 4 is a partially-enlarged view of FIG. 3.
Figure 3:
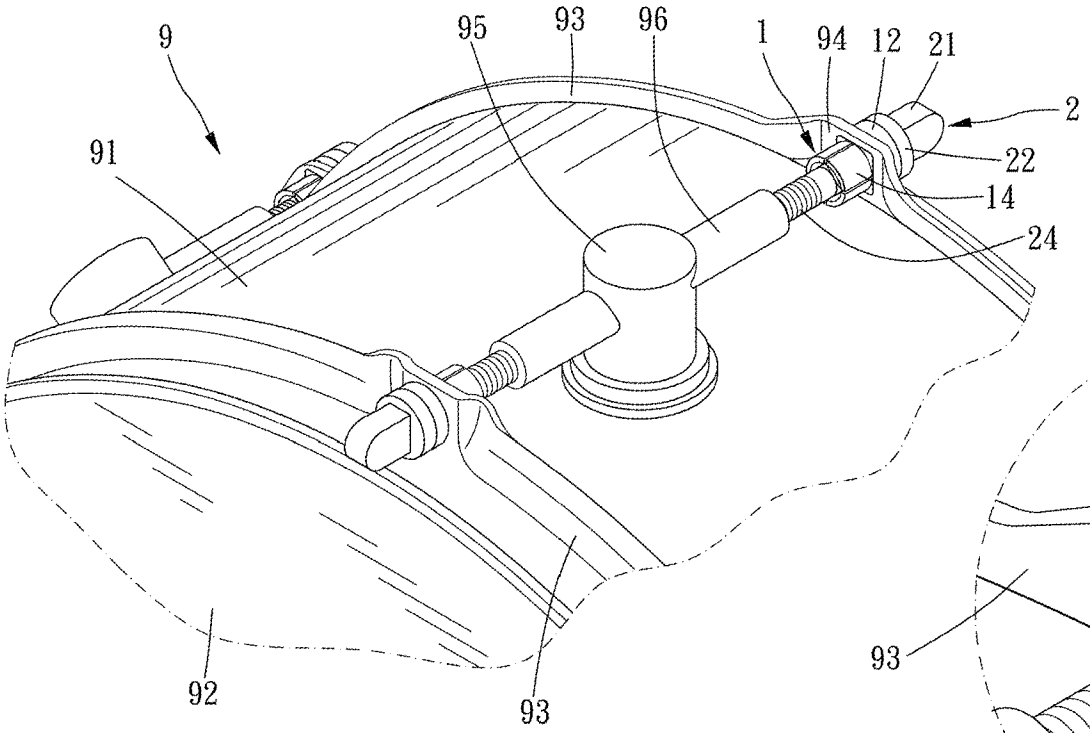
FIG. 3 is a partial view of the first preferred embodiment of the present invention.
Figure 5:
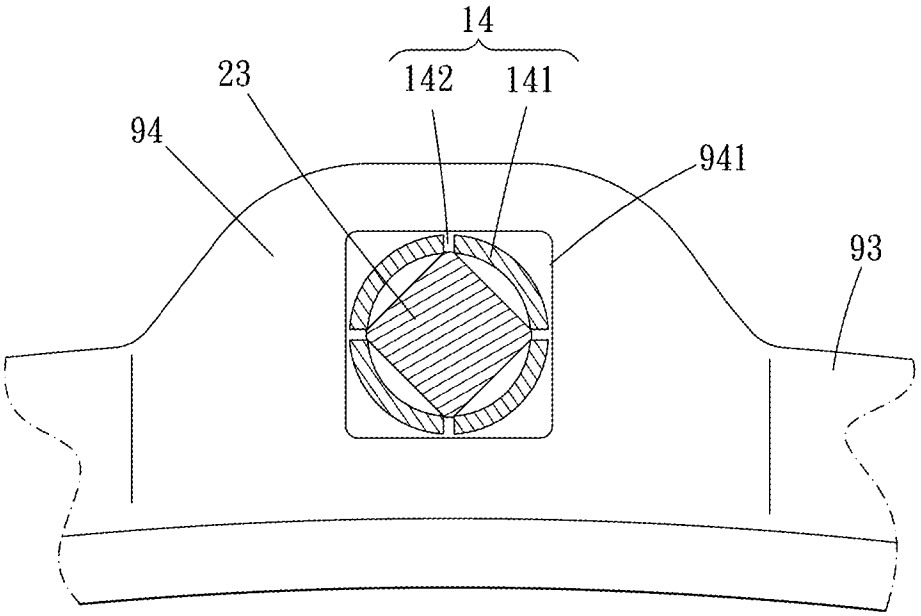
FIG. 5 is a partially cross-sectional view of the first preferred embodiment of the present invention.
Figure 6:
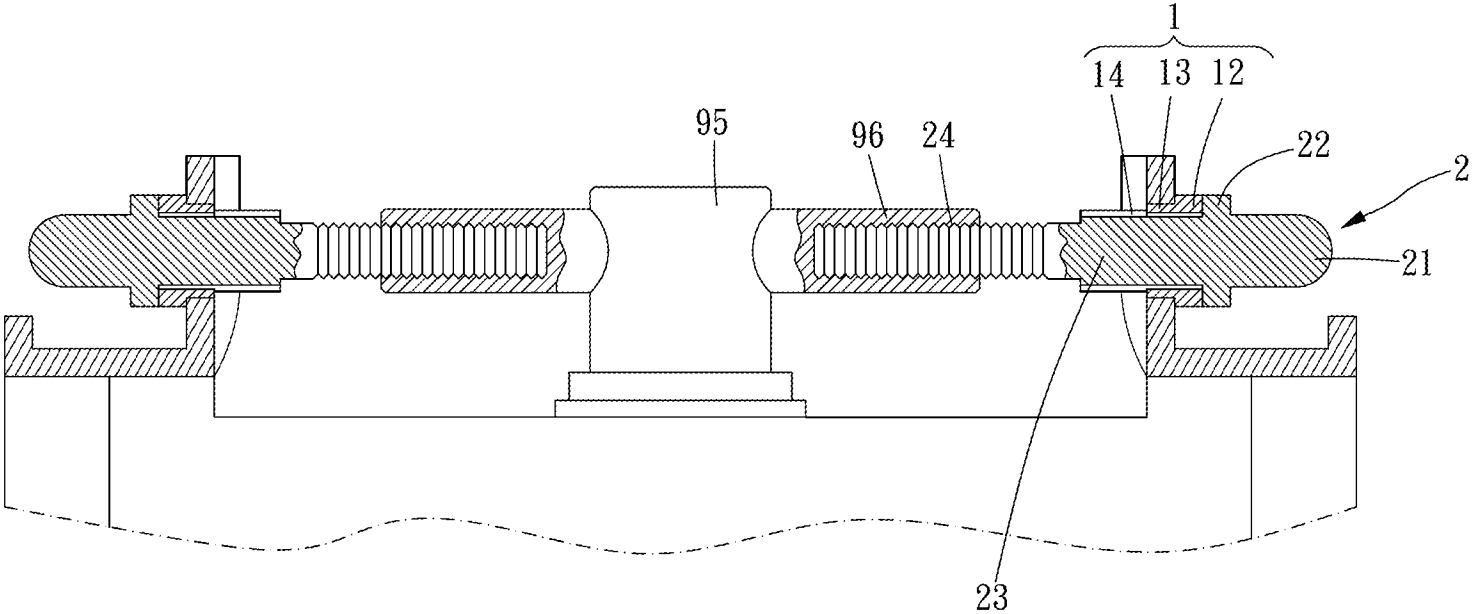
FIG. 6 is another partially cross-sectional view of the first preferred embodiment of the present invention.

The present invention will be clearer from the following description when viewed together with the accompanying drawings, which show, for purpose of illustrations only, the preferred embodiment in accordance with the present invention.

Please refer to FIGS. 1 to 6 for a first preferred embodiment of the present invention. A drum hoop fastening device is for being disposed on a drum 9, the drum 9 includes a drum shell 91, a drumhead 92 arranged on the drum shell 91, a drum hoop 93 covering an opening end of the drum shell 91 and the drumhead 92 and a first connecting portion 94 arranged on the drum hoop 93, an exterior circumferential wall of the drum shell 91 has a second connecting portion 95, the first connecting portion 94 has a first through hole 941 along an axial direction, the second connecting portion 95 has a connecting hole 951 along the axial direction, and the drum hoop fastening device includes a fixing member 1 and a fastening member 2. In this embodiment, the first connecting portion 94 of the drum 9 is arranged on the drum hoop 93 and is integrally formed with the drum hoop 93.

The fixing member 1 is abutted against a part of the drum 9. For example, the fixing member 1 is abutted against one of the drum shell 91 and the drum hoop 93. In this embodiment, the fixing member 1 is positioned in one of the first through hole 941 and the connecting hole 951, and the fixing member 1 has a second through hole 11 along the axial direction. In this embodiment, the fixing member 1 is located in the first through hole 941. The fixing member may be a plate member and located between the first through hole and the connecting hole, and the fixing member is abutted against the drum shell, wherein the fixing member is blocked by the drum shell for preventing free rotation of the fixing member relative to the drum shell. The fixing member may include a plurality of radial projections, an annular groove annularly extending across the plurality of radial projections, and an elastic ring disposed within the annular groove. The plurality of radial projections define the second through hole.

The fastening member 2 is disposed through the first and second through holes 941, 11 and screwed with the connecting hole 951 for fixing the drum hoop 93 on the drum shell 91, and when the fastening member 2 rotates, an exterior circumferential wall of the fastening member 2 circumferentially interferes the fixing member 1.

The fastening member 2 sequentially has a head portion 21 for driving, a middle section 23 and a threaded section 24, at least one part of the middle section 23 is located in the second through hole 11, during every rotation of the fastening member 2 within the second through hole 11, the middle section 23 of the fastening member 2 circumferentially interferes a wall of the second through hole 11, and at least one of a circumferential wall of the middle section 23 and the wall of the second through hole 11 is radially recoverably deformable. When the fastening member 2 rotates, the exterior circumferential wall of the fastening member 2 circumferentially interferes the fixing member 1; therefore, when the drum 9 is hit and vibrates, the fastening member 2 can be prevented from being vibrated and rotating randomly relative to the fixing member 1, and the fastening member 2 will not fall off from the drum hoop 93.

At least one of the circumferential wall of the middle section 23 and the wall of the second through hole 11 is non-circular. Preferably, both the middle section 23 and the wall of the second through hole 11 are non-circular (not limited thereto) so that the fastening member 2 and the fixing member 1 can preferably interfere with each other. In this embodiment, the middle section 23 is a polygonal column (in this embodiment, the middle section 23 is a quadrangular column).

Specifically, the first through hole 941 is preferably a non-circular hole (in this embodiment, the first through hole 941 is a rectangular hole), the fixing member 1 sequentially has an abutting section 12, a non-circular section 13 and an interfering section 14, and the non-circular section 13 is located in the first through hole 941 and corresponds to the first through hole 941 in shape (rectangular) to prevent the fixing member 1 from rotating in the first through hole 941. In this embodiment, a restricting portion 22 which has greater diameter relative to the head portion 21 is further provided between the head portion 21 and the middle section 23, and the restricting portion 22 abuts the abutting section 12 axially against the first connecting portion 94 so that the fastening member 2 can stably fix the drum hoop 93 on the drum shell 91. It is understandable that in other embodiments, the fixing member 1 can be positioned in the connecting hole 951, and the exterior circumferential wall of the fastening member 2 can still circumferentially interfere with the fixing member 1 so as to effectively prevent the fastening member 2 from rotating randomly relative to the fixing member 1.

It is to be noted that in this embodiment, the interfering section 14 has a plurality of petals 141 which are radially flareable and recoverable, every two of the plurality of petals 141 form a through slot 142, the through slots 142 extend along the axial direction, the middle section 23 is located in the interfering section 14, and when the fastening member 2 rotates, the middle section 23 circumferentially interferes the petals 141. Therefore, when the drum 9 is hit and vibrates, the middle section 23 circumferentially interferes the petals 141, the fastening member 2 will not rotate relative to the fixing member 1 and will not move axially, and it is more convenient for a user to screw the fastening member 22 to adjust sounds of the drum 9 when being hit. When the user wants to make the fastening member 2 and the fixing member 1 rotate relative to each other, s/he can apply a greater force to make the middle section 23 abut against the petals 141 to make the petals 141 deform, and then the fastening member 2 can rotate relative to the fixing member 1 to adjust a tightness of the fastening member 2. It is understandable that in other embodiments, the middle section and the interfering section may be in other structures, for example, at least one of the middle section and the interfering section may have at least one rib sheet which extend radially to make the middle section circumferentially interfere the interfering section to prevent the fastening member from loosening.

In this embodiment, the head portion 21, the middle section 23 and the threaded section 24 are integrally formed in one piece, and the abutting section 12, the non-circular section 13 and the interfering section 14 are integrally formed in one piece, but not limited thereto. Preferably, the fastening member 2 is a metal bolt, and the fixing member 1 is a metal cushion so that the fastening member 2 and the fixing member 1 have greater structural strength to elevate durability of the fastening member 2 and the fixing member 1.

In the present invention, the drum 9 is further provided, including the drum hoop fastening device mentioned above, and the drum 9 further includes the drum shell 91, at least one said drumhead 92, at least one said drum hoop 93 and at least one said first connecting portion 94. The exterior circumferential wall of the drum shell 91 has a plurality of said second connecting portions 95. The at least one drumhead 92 is arranged on the drum shell 91. The at least one drum hoop 93 covers the opening end of the drumhead 92 and the drum shell 91. Each said first connecting portion 94 has the first through hole 941 along the axial direction. In this embodiment, the drum 9 includes two said drumheads 92, two said drum hoops 93 and a plurality of said first connecting portions 94, the two drum hoops 93 and the two drumheads 92 are respectively arranged on two opposite opening ends of the drum shell 91, and the first connecting portions 94 are respectively arranged on the two drum hoops 93.

Each said second connecting portion 95 further has at least one connecting tube 96, each said connecting tube 96 extends toward one said drum hoop 93, and each said connecting tube 96 is screwed with one said fastening member 2. When the fastening member 2 rotates, the middle section 23 of each said fastening member 2 circumferentially interferes with the fixing member 1 so as to prevent the fastening members 2 from loosening due to vibration of the drum 9.

Figure 7:
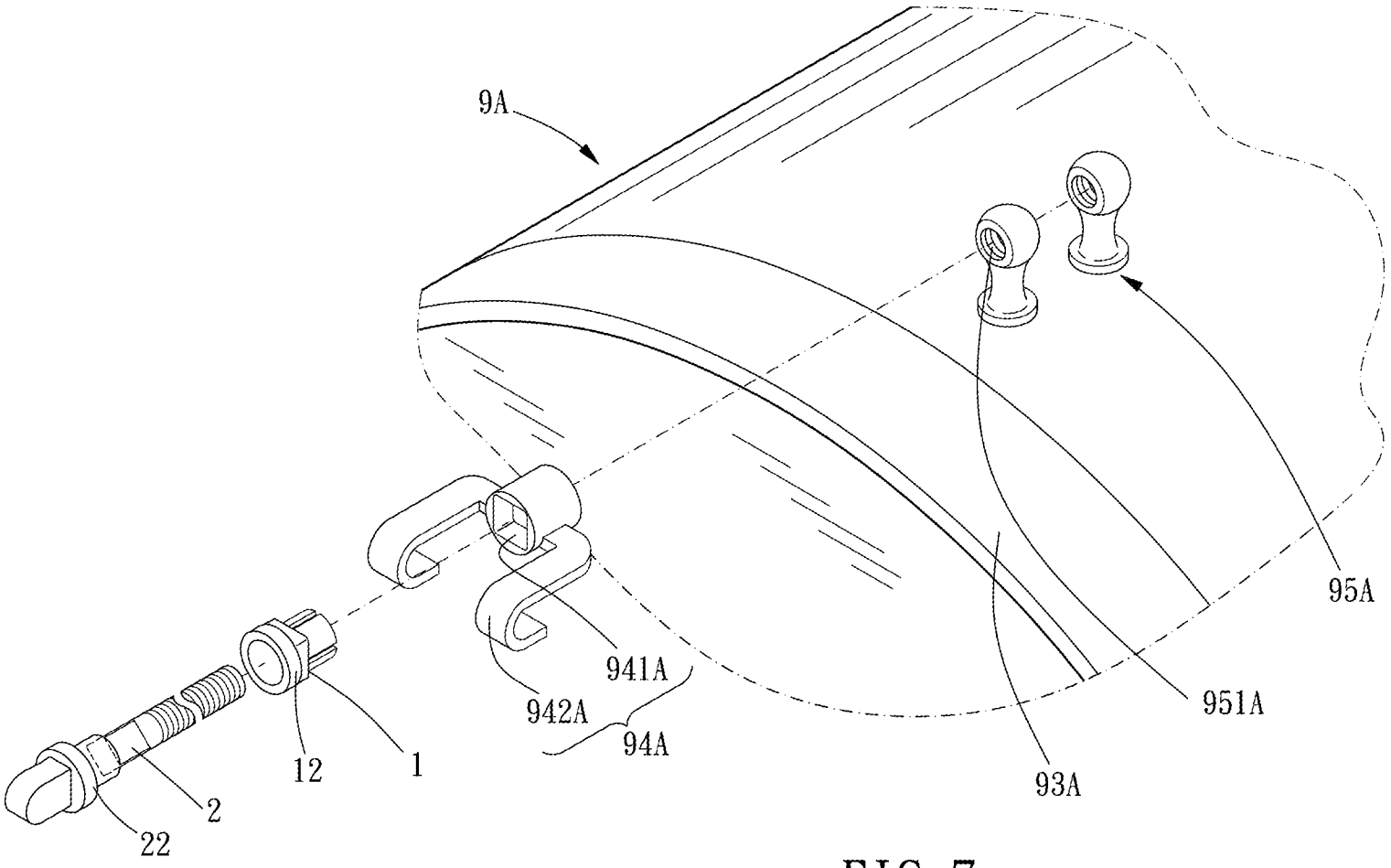
FIG. 7 is a partially breakdown view of a second preferred embodiment of the present invention.
Figure 8:
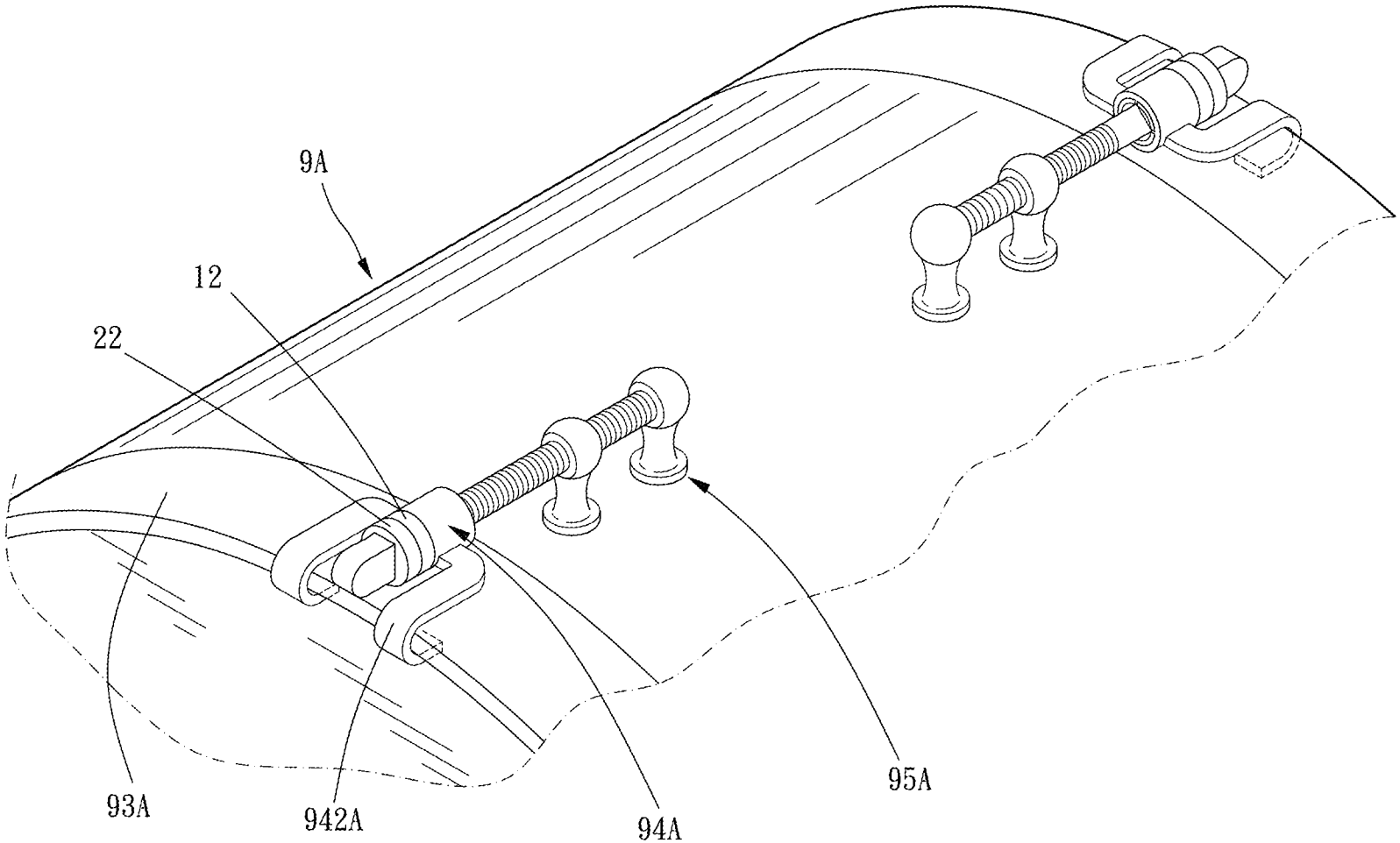
FIG. 8 is a partial view of the second preferred embodiment of the present invention.

Please refer to FIGS. 7 and 8. Compared with the first embodiment mentioned above, in a second embodiment of the present invention, a first connecting portion 94A of a drum 9A includes at least one hook portion 92A. In this embodiment, there are two said hook portions 92A, the two hook portions 92A extend from an exterior circumferential wall of a first through hole 941A and detachably hook a drum hoop 93A, the fastening member 2 is disposed through the first through hole 941A and screwed with a connecting hole 951A of a second connecting portion 95A, and when the fastening member 2 rotates, the exterior circumferential wall of the fastening member 2 can still circumferentially interfere with the fixing member 1 to effectively prevent the fastening member 2 from rotating randomly relative to the fixing member 1 and prevent the fastening member 2 from loosening from the drum hoop 93A.

Given the above, in the fastening device, the drum hoop fastening device and the drum having the same, when the fastening member rotates, the exterior circumferential wall of the fastening member circumferentially interferes with the fixing member to prevent the fastening member from rotating randomly relative to the fixing member. In addition, when the user wants to make the fastening member and the fixing member rotate relative to each other, s/he can apply a greater force to make the middle section abut against the petals to make the petals deform, and then the fastening member can rotate relative to the fixing member to adjust a tightness of the fastening member.

While we have shown and described various embodiments in accordance with the present invention, it should be clear to those skilled in the art that further embodiments may be made without departing from the scope of the present invention.

What is claimed is:

1. A drum hoop fastening device, for being disposed on a drum, the drum including a drum shell, a drumhead arranged on the drum shell, a drum hoop covering an opening end of the drum shell and the drumhead and a first connecting portion arranged on the drum hoop, an exterior circumferential wall of the drum shell having a second connecting portion, the first connecting portion having a first through hole along an axial direction, the second connecting portion having a connecting hole along the axial direction, the drum hoop fastening device including:

a fixing member, abutted against the drum, the fixing member having a second through hole along the axial direction;

a fastening member, disposed through the first and second through holes and screwed with the connecting hole for fixing the drum hoop on the drum shell, during every rotation of the fastening member within the second through hole, at least part of an exterior circumferential wall of the fastening member which is non-circular and within the second through hole circumferentially interferes with a wall of the second through hole, and at least one of the at least part of the exterior circumferential wall of the fastening member and the wall of the second through hole is radially recoverably deformable.

2. The drum hoop fastening device of claim 1, wherein the fixing member is positioned in one of the first through hole and the connecting hole, the fastening member sequentially has a head portion for driving, a middle section and a threaded section, at least one part of the middle section is located in the second through hole, during every rotation of the fastening member within the second through hole, the at least one part of the middle section of the fastening member circumferentially interferes the wall of the second through hole, and at least one of a circumferential wall of the at least one part of the middle section and the wall of the second through hole is radially recoverably deformable.

3. The drum hoop fastening device of claim 2, wherein at least one of the circumferential wall of the middle section and the wall of the second through hole is non-circular.

4. The drum hoop fastening device of claim 3, wherein the middle section is a polygonal column.

5. The drum hoop fastening device of claim 4, wherein the head portion, the middle section and the threaded section are integrally formed in one piece.

6. The drum hoop fastening device of claim 2, wherein the first through hole is a non-circular hole, the fixing member sequentially has an abutting section, a non-circular section and an interfering section, the non-circular section is located in the first through hole and corresponds to the first through hole in shape, a restricting portion which has greater diameter relative to the head portion is further provided between the head portion and the middle section, and the restricting portion abuts the abutting section axially against the first connecting portion.

7. The drum hoop fastening device of claim 6, wherein the interfering section has a plurality of petals which are radially flareable and recoverable, every neighboring two of the plurality of petals form a through slot, the through slots extend along the axial direction, the middle section is located in the interfering section, and when the fastening member rotates, the middle section circumferentially interferes the petals.

8. The drum hoop fastening device of claim 7, wherein the abutting section, the non-circular section and the interfering section are integrally formed in one piece.

9. A drum, including the drum hoop fastening device of claim 1, further including:

a drum shell, an exterior circumferential wall of the drum shell having a plurality of second connecting portions;

at least one drumhead, arranged on the drum shell;

at least one drum hoop, covering an opening end of the drumhead and the drum shell;

at least one first connecting portion, each said first connecting portion having a first through hole along an axial direction.

10. The drum of claim 9, wherein each said second connecting portion further has at least one connecting tube, each said connecting tube extends toward one said drum hoop, and each said connecting tube is screwed with one said fastening member.

11. The drum of claim 9, wherein each said first connecting portion and the drum hoop are integrally formed in one piece.

12. The drum of claim 9, wherein the first connecting portion includes at least one hook portion, and the at least one hook portion extends from an exterior circumferential wall of the first through hole and detachably hooks the drum hoop.

* * * * *